United States Patent [19]

Hughes et al.

[11] 4,430,921

[45] Feb. 14, 1984

[54] ARMATURE WITH GRADED LAMINATIONS

[75] Inventors: William F. Hughes, Cambridge Springs; Frederick J. Young, Bradford, both of Pa.

[73] Assignee: Westinghouse Electric Corp., Pittsburgh, Pa.

[21] Appl. No.: 324,908

[22] Filed: Nov. 25, 1981

[51] Int. Cl.[3] ..... F41F 1/02

[52] U.S. Cl. ..... 89/8; 124/3

[58] Field of Search ..... 124/3; 89/8

[56] References Cited

U.S. PATENT DOCUMENTS

| | | | |
|---|---|---|---|
| 4,343,223 | 8/1982 | Hawke et al. | 89/8 |
| 4,347,463 | 8/1982 | Kemeny et al. | 124/3 |
| 4,355,561 | 10/1982 | Kemeny et al. | 89/8 |
| 4,369,691 | 1/1983 | Baehr, Jr. et al. | 89/8 |
| 4,369,692 | 1/1983 | Kemeny | 89/8 |

OTHER PUBLICATIONS

"Megagauss Physics and Technology", Plenum Press, N.Y. (6/1/79), pp. 292–294, John Barber.

*Primary Examiner*—Sal Cangialosi

*Attorney, Agent, or Firm*—F. J. Baehr, Jr.

[57] ABSTRACT

The conductivity of the laminations in an armature which conducts current between the launcher rails or switch rails of an electromagnetic propulsion system is graded such that uniform current density is achieved in each lamination. The conductivity of each lamination, which increases from the breech end to the muzzle end of the armature, is related to that of the lamination at the breech end by a single proportionality factor which is a function of the length of the armature in the direction of armature travel, the half-width of the gap between the rails, the velocity of the armature, the magnetic permeability of the rails, and the conductivity of the breech laminations and of the rails.

7 Claims, 6 Drawing Figures

ARMATURE WITH GRADED LAMINATIONS

BACKGROUND OF THE INVENTION

1. Field of the Invention

This invention relates to an armature for conducting very large currents between two parallel rails as it slides along the rails and more particularly it has application to such an armature for apparatus used in the electromagnetic propulsion of projectiles.

2. Description of the Prior Art

In the electromagnetic propulsion of projectiles, a very large dc current, on the order of several hundred thousand amperes, is injected into the breech end of a pair of parallel rails. A projectile which is in sliding contact with the rails is driven toward the muzzle end of the rails where it is ejected at a very high velocity, on the order of several kilometers per second, by the electromagnetic forces generated by the very large current. In many of these projectile launching assemblies, the projectile is provided with an armature which conducts the current between the rails. Originally, the projectile itself was a solid conducting body which served as the aramature. Subsequent projectiles included a separate armature, made up of "leaves" of conductive material affixed to the rear of the projectile. The leaves were stacked in the direction of movement of the projectile with each leaf bridging the gap between the rails. The purpose of the laminated armature was to provide better sliding electrical contact between the armature and the rails. Electrical contact was enhanced by making the laminations of resilient, conductive sheets bent about an axis transverse to the direction of armature movement in a chevron configuration so that when the armature was placed between the rails, the ends of each leaf trailed toward the breech end of the launched end and were biased against the adjacent rails. In some configurations the center portion of each lamination was perpendicular to the rails with just the ends trailing rearward.

Experience has shown that with these prior art armatures, the current is concentrated in the corners of the armature adjacent the breech end of the rails. The higher current density at these points causes them to become hot spots. While the multiple leaf configuration reduces this current concentration somewhat, true uniform current distribution among multiple leaves cannot be achieved (at any armature velocity) no matter how thin the individual leaves are made if they are all identical. In fact, the discovery that practically all of the current was carried by the rearmost leaf, led one researcher to discard all of the chevron shaped leaves except one. This single leaf was then laminated from sheet oriented parallel to the rail faces to provide the multifinger contact between the rails and the armature.

The arrangement of a conductive armature driven down the gap between two parallel conducting rails is also used in some electromagnetic propulsion systems as a firing switch for injecting the very large dc current into the launcher rails. The launcher rails are connected to one rail of the switch on either side of a non-conducting section of the switch rail. Then, as the switch armature, which is driven by the very large dc current down the switch rails, passes the non-conducting section of the one switch rail, the current is commutated into the launcher rails. This switch armature therefore carries the full current applied to the launcher rails and is subjected to the same heating problems associated with current concentration at the rear corners as is the projectile armature. The situation is of even more concern in the case of the switch armature since it is intended to be used over and over again for firing the launcher unlike the projectile armature which ordinarily need survive only one shot.

Rail switches have also been proposed for use as a power switch in an electromagnetic propulsion system in which a kinetic energy storage device, such as a homopolar generator, applies a very large dc current to an inductive energy storage device which is in series with the firing switch. When firing is completed the homopolar generator is removed from the circuit by the power switch and the inductor is crowbarred across the firing switch to dissipate the stored inductive energy. The armature of this rail type switch also carries the full system current and is intended to be used repeatedly so that excessive heating at the breech corners is undesirable.

SUMMARY OF THE INVENTION

According to the invention, the armature for conducting very large currents between a pair of electrically conductive parallel rails which being driven down the rails under the influence of the electromagnetic forces generated by the application of the very large current to the breech end of the rails, comprises a plurality of laminations of electrically conductive material stacked in the direction of armature movement from the breech end toward the muzzle end of the rails. The relative electrical conductivity of each lamination increases from those closest the breech end of the rails to those closest to the muzzle end such that, for a selected velocity of the armature, the current density through each lamination is constant.

We have found that the relationship between the conductivities of the various laminations which results in a uniform current density in all laminations, can be determined through the use of a single proportionality factor and by relating the conductivity of each lamination to that of the lamination closest to one end, namely the breech end, of the armature. Specifically, the proportionality factor is a function of the length of the laminated armature in the direction of armature travel, the width of the gap between the rails, the velocity of the armature, the conductivity of the lamination closest to the breech, and the conductivity and magnetic permeability of the rails.

The laminations may extend transversely across the gap between the rails or they may trail toward the breech end of the rails either over the entire width of the gap or just in the portions adjacent the rails.

DESCRIPTION OF THE PREFERRED EMBODIMENTS

Figure 1:
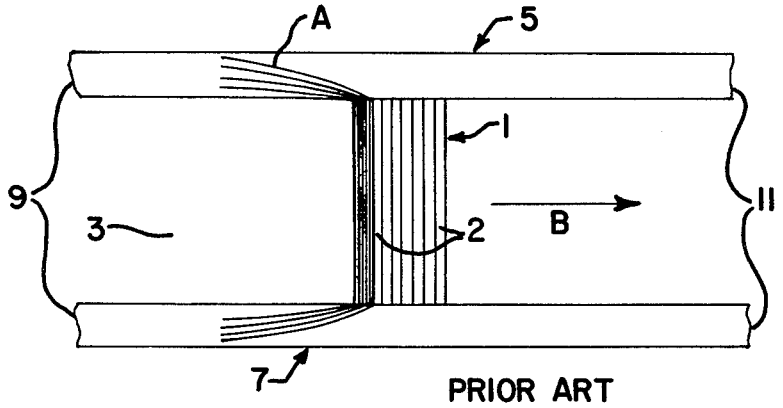
FIG. 1 is a schematic illustration of a prior art armature shown in position between the rails of an electromagnetic propulsion system and illustrating the current distribution therein.

FIG. 1 illustrates a typical prior art armature 1 used in an electromagnetic propulsion system. In such a system, the armature 1 is placed in the gap 3 between a pair of parallel, electrically conductive rails 5 and 7. The armature 1 is in sliding electrical contact with the rails 5 and 7 such that it conducts therebetween a very large current applied to the breech end 9 of the rails as shown by the arrows A. The geometry of this arrangement is such that the electromagnetic forces generated drive the armature toward the muzzle end 11 of the rails as shown by the arrow B.

Typically, the armature 1 has been made up of laminations 2 of electrically conductive material stacked in the direction of armature movement (see arrow B). Each lamination has heretofore been made of the same material with the same physical dimensions, hence the conductivity of each lamination is the same. While this has to some extent relieved the tendency of the armature to become hotter at the breech corners 13 where the current density is highest as shown by FIG. 1, the current is still concentrated in the laminations closest to the breech end of the rails with little or no current being carried by those closest to the muzzle end of the rails. In fact, uniform current density among the laminations cannot be achieved at any velocity, no matter how thin the laminations are made, as long as they are made of the same material with the same conductivity.

We have found, however, that by grading the conductivity of the laminations, the current density can be essentially equalized across all of the laminations. Although a perfectly uniform current distribution may be achieved at only one velocity of the armature, a compromise can be effected to realize a nearly uniform heat input to each lamination over the residence time of the armature in the gap between the rails.

We have found that a uniform current density in all the laminations may be achieved when the conductivity of each lamination is determined according to the following relationship:

$$\sigma^* = \frac{\sigma}{\sigma_o} = \left[ \frac{2\alpha}{3} [(1 - X^*)^{3/2} - 1] + 1 \right]^{-1} \quad (1)$$

where:

$\sigma$ = conductivity of the selected lamination $\sigma_o$ = conductivity of the lamination closest to breech $\sigma^*$ = conductivity of the selected lamination normalized to conductivity of the breech lamination $X^*$ = relative distance of the selected lamination from the breech lamination (the ratio of the distance, X, of the selected lamination from the breech lamination to the total length, l, of the armature).

$\alpha$ = a proportionality factor

Thus it can be seen from equation (1) that the normalized conductivity of a lamination which is a distance X from the breech lamination in an armature having a length l depends only upon the proportionality factor $\alpha$.

Figure 2:
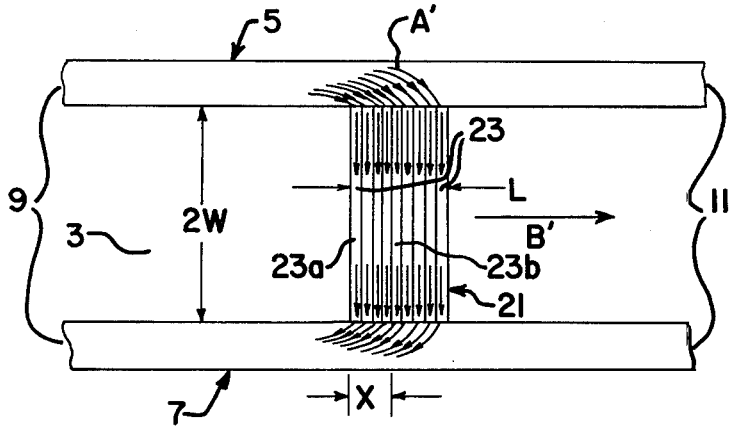
FIG. 2 is a schematic illustration of an armature according to the present invention also shown in position between the rails of an electromagnetic propulsion system and illustrating the uniform current distribution achieved thereby.

FIG. 2 illustrates an armature constructed in accordance with the relationship expressed in equation (1). The armature 21 is made up of a number of laminations 23 of electrically conductive material stacked in the direction B' of armature movement from the breech end 9 to the muzzle end 11 of the rails 5 and 7 with each lamination bridging the gap 3 between the rails. The total length, l, of the armature in the direction of armature movement is equal to the sum of the thicknesses of the individual laminations 23. The distance of a selected lamination, such as 23*b*, from the breech lamination 23*a* is equal to the distance X and the width of the gap 3 is equal to 2 W.

Using these dimensions, the proportionality factor is determined from the following relationship.

$$\alpha = \frac{\sigma_o}{\sigma_r} \cdot \frac{l}{W} \cdot \sqrt{\frac{ul\mu\sigma_r}{\pi}} \quad (2)$$

where:

$\sigma_o$ = conductivity of the breech lamination $\sigma_r$ = conductivity of the rails l = length of armature in the direction of armature movement W = half width of gap between rails u = velocity of the armature $\mu$ = magnetic permeability of the rails From equation (2) it is evident that since the grading of the conductivity in the suggested manner is dependent upon armature velocity, a precisely uniform distribution of current throughout the laminations is only achieved at the selected velocity. However, this relationship provides a reasonable compromise which results in essentially uniform current distribution over the residence time of the armature between the rails.

Figure 3:
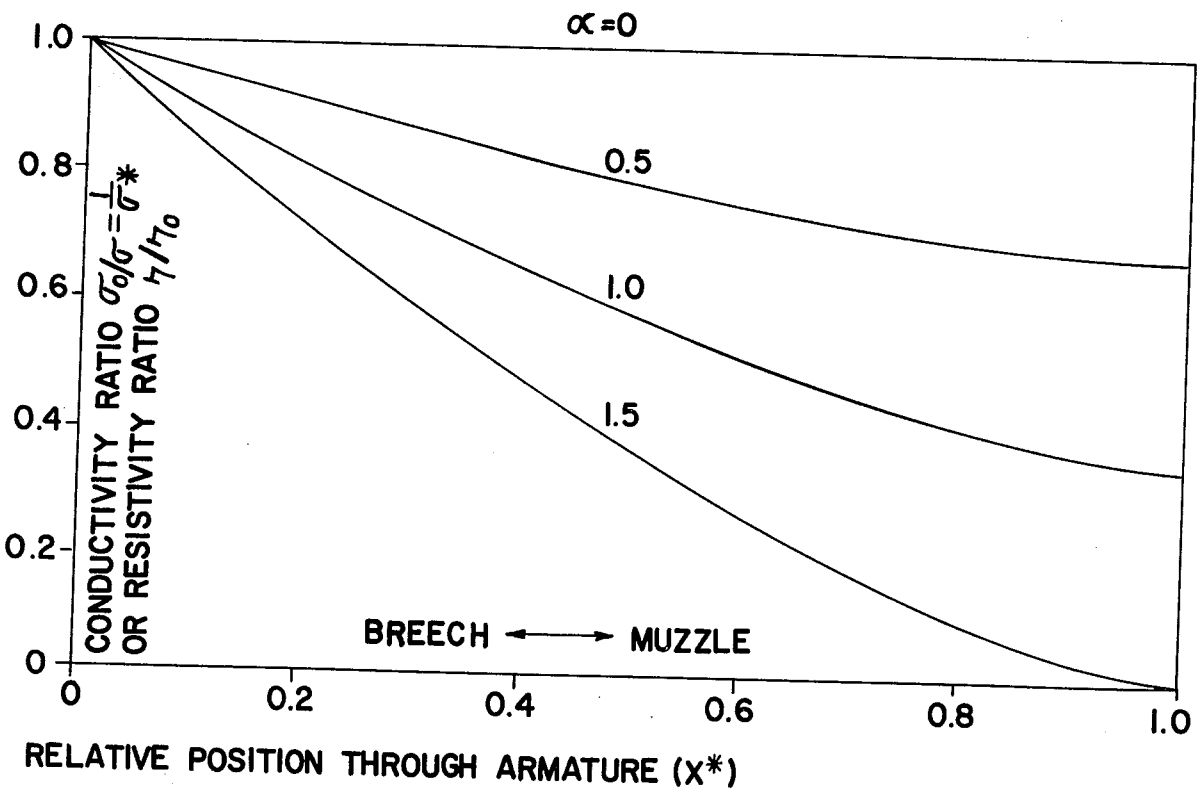
FIG. 3 is a plot of the relative resistivity along the length of an armature made in accordance with the invention for selected values of the parameter $\alpha$ defined hereinafter.

The conductivity grading profile as a function of $X^*$, (x/l) for various values of $\alpha$ is shown in FIG. 3. This is a plot of the inverse of $\sigma^*$ (equation (1)), or the ratio of the conductivity of the breech lamination, $\alpha_o$, to that of an individual lamination $\sigma$. Since the reciprocal of the conductivity is the resistivity, this plot may be viewed as the ratio of local resistivity, $\eta$, of an individual lamination to that of the breech lamination, $\eta_o$. As can be seen from equation (2) and FIG. 3, an $\alpha$ of 1.5 represents the maximum value of this parameter for which grading will effect uniform current distribution in the armature. Furthermore, at an $\alpha$ of 1.5, the conductivity of the muzzle lamination 23*c*, becomes impractically large. Hence, the proportionality factor $\alpha$ must be kept below the maximum value of 1.5 by adjusting the values of l, W and/or $\sigma_r$. In practice, $\alpha$ will generally be considerably lower than unity.

Figure 4:
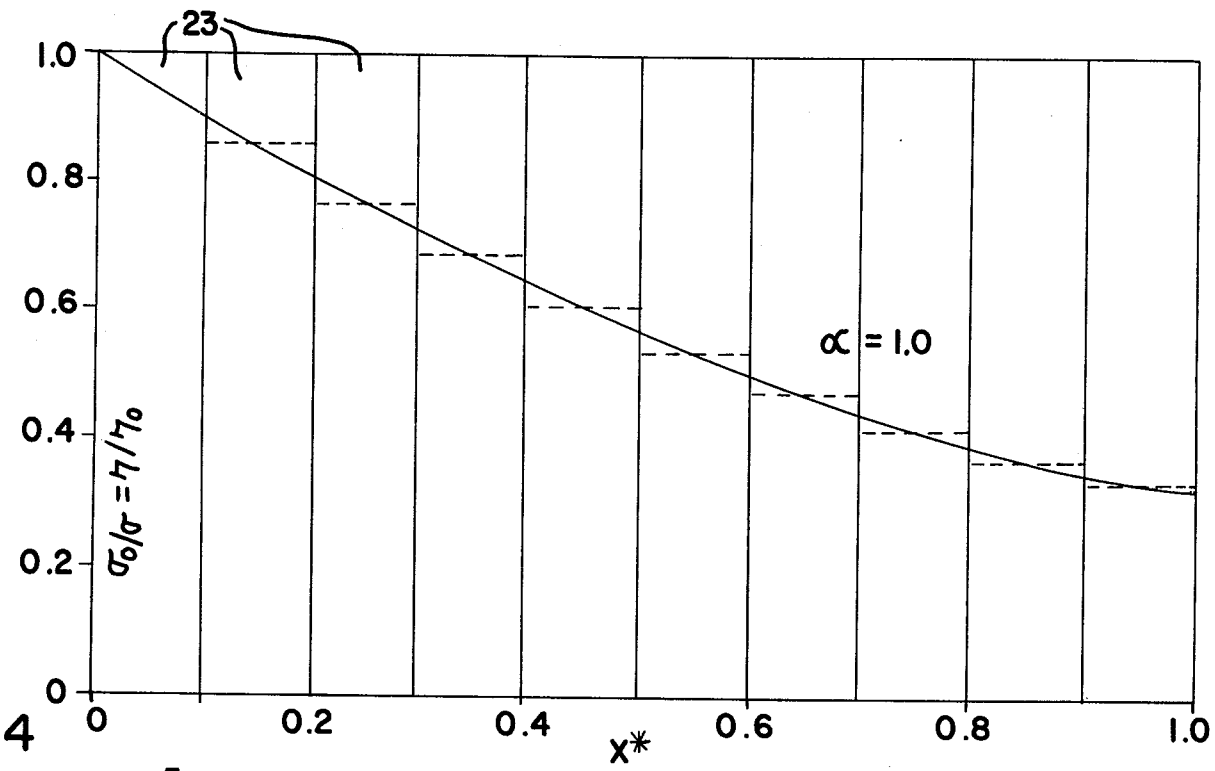
FIG. 4 is a plot of the relative resistivity of a laminated armature according to the invention for a specified value of $\alpha$.

FIG. 4 illustrates that, in practice, the relative position axis $X^*$ of FIG. 3 is divided up into as many equal segments as there are laminations 23. Each lamination is then given the mean conductivity indicated by the associated segment of the plot of $\alpha$. In the example shown there are 10 laminations and $\alpha = 1.0$.

Figure 5:
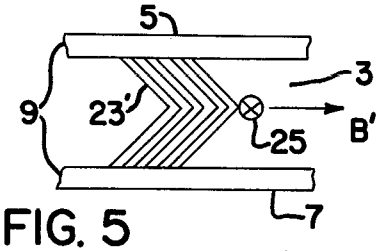
FIG. 5 is a schematic illustration of a modified form of an armature made in accordance with the teachings of the invention.
Figure 6:
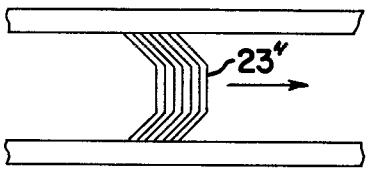
FIG. 6 is a schematic illustration of another modified form of an armature made in accordance with the teachings of the invention.

It is not necessary that the laminations 23 be normal to the confronting faces of the rails. As shown in FIG. 5, they may be bent about an axis 25 transverse to the direction of armature movement B and to the plane formed by the rails (the plane of FIG. 5) with the bent sections trailing toward the breech end 9 of the rails 5 and 7 in a chevron configuration as has been done in the past. By making these V-shaped laminations 23' of resilient, electrically conductive material, and sizing them slightly greater in span than the gap 3, a better sliding electrical contact between the rails and the armature laminations is achieved. As seen in FIG. 6, only the portions of the laminations 23'' adjacent the rails need be bent in the direction of the breech end of the rails in a modified chevron configuration. Whatever the configuration, the essential feature is to grade the conductivity of each lamination relative to the others such that substantially uniform current distribution is achieved across all the laminations.

Armatures with laminations graded in accordance with the teachings of this invention may be used, for example as projectile armatures in electromagnetic rail launchers, as switch armatures in the rail switches used to commutate the current into the launcher rails of some rail launcher systems, or as the armature of the rail type power switch discussed above. The armature could also be used in other applications where an armature carrying a very large current moves at high velocity down the gap between a pair of electrically conductive rails.

We claim:

1. An armature for conducting a very large dc current between two parallel, electrically conductive rails while being driven down the gap between the rails under the influence of the electromagnetic forces generated by the application of said very large dc current to the breech end of said rails, said armature comprising a plurality of laminations of electrically conductive material stacked in the direction of travel of the armature from the breech end to the muzzle ends of said rails and each ridging said gap between the rails, with the relative electrical conductivity of each lamination increasing from those closest to the breech end of the rails to those closest to the muzzle end of the rails such that for a selected velocity of the armature as it is driven toward the muzzle end of the rails by said very large dc current, the current density through each lamination is substantially the same.

2. The armature of claim 1 wherein all of the laminations are of substantially the same thickness.

3. The armature of claim 1 wherein the conductivity of each lamination is selected according to the relationship:

$$\sigma^* = \left[ \frac{2\alpha}{3} [(1 - X^*)^{3/2} - 1] + 1 \right]^{-1}$$

where $\sigma^*$ is the ratio of the conductivity of a selected lamination to the conductivity of the lamination closest to the breech end of the rails, $X^*$ is the relative distance of a selected lamination from the lamination closest to the breech end of the rails and $\alpha$ is a proportionality factor.

4. The armature of claim 3 wherein $\alpha$ is determined by the relationship:

$$\alpha = \frac{l}{W} \cdot \frac{\sigma_o}{\sigma_r} \sqrt{\frac{ul\mu\sigma_r}{\pi}}$$

where: l=length of the armature in the direction of armature movement, W is the half-width of the gap between the parallel rails, $\sigma_o$ is the conductivity of the lamination closest to the breech end of the rails, $\sigma_r$ is the conductivity of the rails, u is the velocity of the armature and $\mu$ is the magnetic permeability of the rails.

5. The armature of claim 1, 3 or 4 wherein said laminations are made of resilient electrically conductive material bent about an axis transverse to the direction of movement of the armature and to the plane formed by the parallel rails with the sections of each lamination on either side of the bend trailing toward the breech end of said rails.

6. The armature of claim 1, 3 or 4 wherein said laminations are made of resilient conductive material with the planes of the laminations at right angles to the parallel rails.

7. The armature of claim 6 with the portions of the laminations adjacent each rail bent in the direction of the breech end of the rails.

* * * * *